US005392821A

United States Patent [19]

Chudy

[11] Patent Number: 5,392,821

[45] Date of Patent: Feb. 28, 1995

[54] STRAPPING TOOL WITH MECHANISM FOR ADMITTING, RETAINING, AND RELEASING STEEL STRAP

[75] Inventor: Andrzej M. Chudy, Grayslake, Ill.

[73] Assignee: Signode Corporation, Glenview, Ill.

[21] Appl. No.: 133,290

[22] Filed: Oct. 8, 1993

[51] Int. Cl.[6] ..... B21P 9/00

[52] U.S. Cl. ..... 140/93.2

[58] Field of Search ..... 140/93 R, 93.2, 93.4, 140/93.6

[56] References Cited

U.S. PATENT DOCUMENTS

| | | | |
|---|---|---|---|
| 1,939,746 | 12/1933 | Whitman | 140/93.6 |
| 2,210,510 | 8/1940 | Sutton | 140/93.2 |
| 4,825,512 | 5/1989 | Tremper et al. | 24/20 EE |
| 5,136,888 | 8/1992 | Nix | 74/88 |

*Primary Examiner*—Lowell A. Larson
*Attorney, Agent, or Firm*—Schwartz & Weinrieb

[57] ABSTRACT

A strapping tool is disclosed as being of the type used to apply a steel strap in a tensioned loop around a package and to join the strap by a series of interlocking joints comprising interlockable shoulders punched into overlapped ends of the strap. A base of the strapping tool extends longitudinally and defines a pair of recesses. A frame upstanding from the base is integrally mounted upon the base. In a mechanism for admitting the overlapped ends of the straps into the tool, for retaining the overlapped ends of the straps, and for releasing the overlapped ends of the straps from the tool, a pair of latches having hooked ends are pivotably mounted upon the base so as to be pivotable between closed positions wherein the latches are positioned with the hooked ends extending into the recesses so as to retain the overlapped ends of the straps between the latch and the base and between the hooked ends and the frame, and opened positions wherein the latches are displaced angularly from the closed positions so as to admit the overlapped ends of the straps into the tool and to release the overlapped ends of the straps from the tool. The latches are biased to the closed positions. Coacting elements including a lever, which can be manually squeezed toward an actuating handle of the strapping tool, and a camming member, which is arranged to cam the latches, are provided for pivoting the latches from the closed positions to the opened positions.

18 Claims, 4 Drawing Sheets

Fig. 4
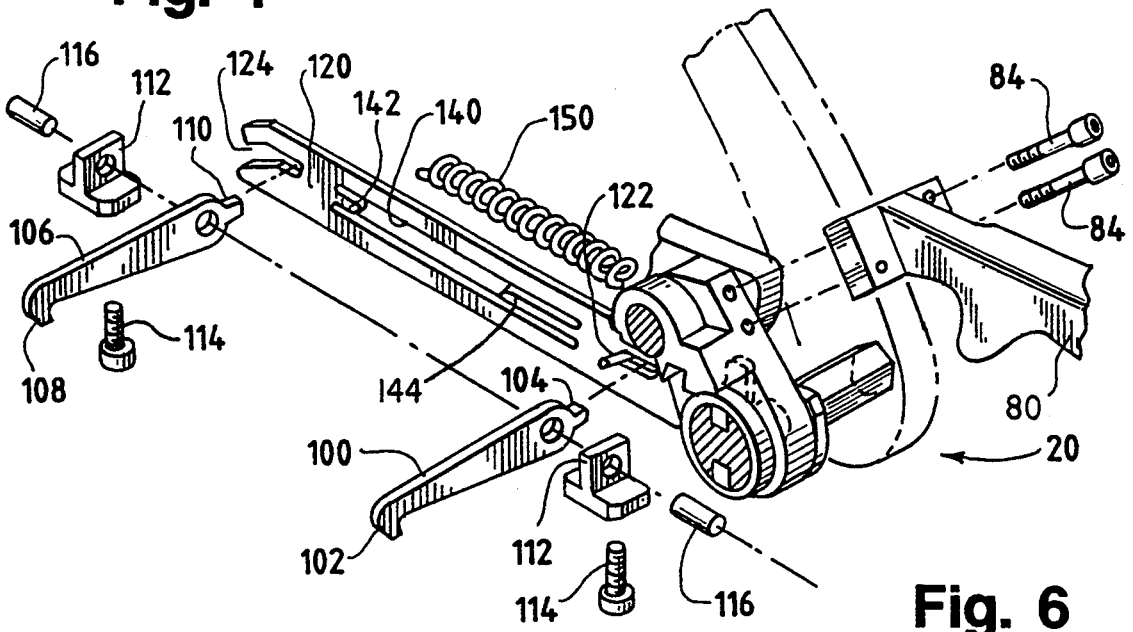
Fig. 6
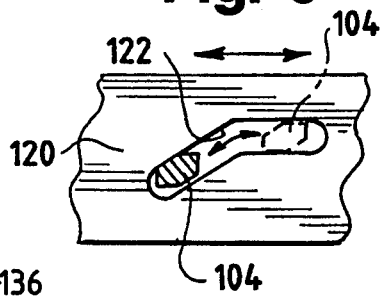
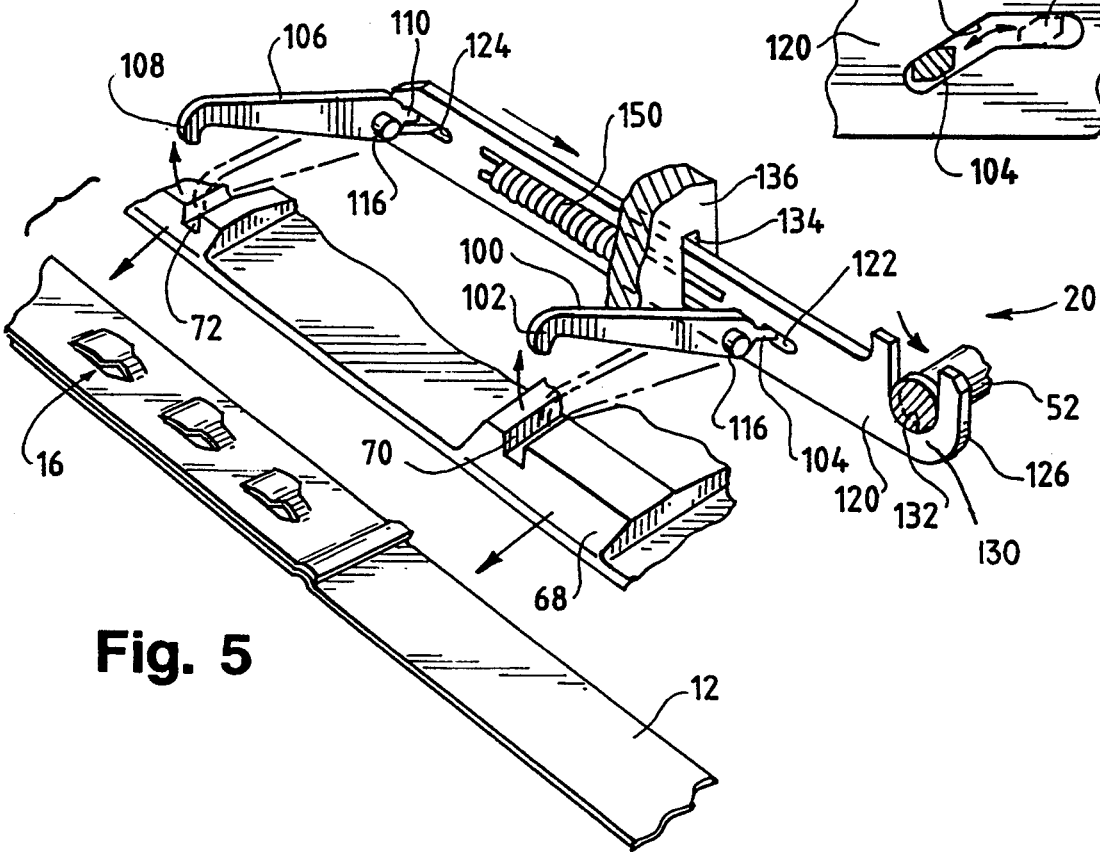
Fig. 5

STRAPPING TOOL WITH MECHANISM FOR ADMITTING, RETAINING, AND RELEASING STEEL STRAP

TECHNICAL FIELD OF THE INVENTION

This invention pertains to a strapping tool of the type used to apply a steel strap in a tensioned loop around a package and to join the strap through means of a series of interlocking joints comprising interlockable shoulders punched into overlapped ends of the strap. This invention provides a novel mechanism for admitting, retaining, and releasing the overlapped ends of the strap.

BACKGROUND OF THE INVENTION

In a strapping tool of the type noted above, an actuating handle is provided, which is arranged to be manually oscillated. The handle rotates an output shaft, which actuates a series of cams, through means of an input shaft, to which the handle is coupled, and intermediate gears. The cams drive a series of punches, which punch interlockable shoulders into overlapped ends of the strap. Tremper et al. U.S. Pat. No. 4,825,512 discloses a current example of such a strap having such a series of interlocking joints.

As disclosed in Nix U.S. Pat. No. 5,136,888, a strapping tool of the type noted above may incorporate a mechanism for converting oscillatory rotation of the input shaft to unidirectional rotation of the output shaft.

SUMMARY OF THE INVENTION

This invention comprises an improved strapping tool of the type noted above. The strapping tool is used to apply a steel strap in a tensioned loop around a package and to join the strap through means of a series of interlocking joints comprising interlockable shoulders punched into overlapped ends of the strap. As the improved invention, the strapping tool comprises a fixed structure, which includes a base extending longitudinally and defining a recess and which includes a frame upstanding from the base, and a mechanism including a latch. The latch is movably mounted upon the fixed structure so as to be selectively movable between a closed position wherein the latch extends into the recess defined by the base so as to retain the overlapped ends between the latch and the base and between the hooked ends and the frame, and opened positions wherein the latch is displaced from the closed position so as to admit the overlapped ends into the tool and to release the overlapped ends from the tool. The mechanism further includes means for moving the latch from the closed position to the opened position.

Preferably, the latch has a hooked end and is pivotably mounted upon to the frame so as to be pivotable between the closed and opened positions, the moving means being arranged for pivoting the latch from the closed position to the opened position. Thus, in the closed position, the hooked end extends into the recess.

Preferably, the moving means comprises a lever pivotably mounted upon the frame so as to be pivotable about an axis between a latching position and an unlatching position. The latching position corresponds to the closed position of the latch and the unlatching position corresponds to the opened position of the latch. The lever is linked to the latch in such a manner that pivoting of the lever from the latching position to the unlatching position results in pivoting of the latch from the closed position to the opened position. The lever is biased toward the latching position so as to bias the latch toward the closed position.

Ordinarily, a strapping tool of the type noted above comprises a handle pivotably mounted upon the frame so as to be pivotable over a range of pivotal movement, between a forward limit of the range and a rearward limit of the range. The handle may be advantageously positioned near the lever, when the actuating handle is positioned at the rearward limit of the range, so as to permit a user employing one hand to then pivot the lever from the latching position to the unlatching position by grasping the actuating handle and the lever and by squeezing the lever toward the handle.

Preferably, the mechanism further comprises a camming member mounted movably mounted upon the frame so as to be longitudinally movable between an advanced position and a retracted position. The advanced position corresponds to the latching position of the lever and to the closed position of the latch. The retracted position corresponds to the unlatching position of the lever and to the opened position of the latch. The lever is linked to the camming member in such a manner that pivoting of the lever from the latching position to the unlatching position results in longitudinal movement of the camming member from the advanced position to the retracted position. The camming member is biased to the advanced position so as to bias the lever to the latching position. The camming member has a camming slot coacting with the latch so as to pivot the latch from the closed position to the opened position upon longitudinal movement of the camming member from the advanced position to the retracted position and so as to pivot the latch from the opened position to the closed position upon longitudinal movement of the camming member from the retracted position to the advanced position.

Preferably, the axis about which the lever is pivotable is a transverse axis, and the mechanism further comprises a transverse member spaced from the transverse axis and movable about the transverse axis as the lever is pivoted about the transverse axis. Preferably, moreover, the camming member has an end portion defining an aperture, through which the transverse member extends, the end portion coacting with the transverse member in such a manner that the transverse member moves the camming member from the advanced position to the retracted position upon pivoting of the lever from the latching position to the unlatching position.

BRIEF DESCRIPTION OF THE DRAWINGS

These and other objects, features, and advantages of this invention will be evident from the following description of a preferred embodiment of this invention with reference to the accompanying drawings, in which like reference characters designate like or corresponding parts throughout the several views, and wherein:

FIG. 4 is a fragmentary, perspective, exploded view of some elements of a mechanism of the strapping tool for admitting, retaining, and releasing the overlapped ends of a steel strap, which is not shown.

FIG. 5 is a fragmentary, perspective, assembled view of some elements of the mechanism for admitting, retaining, and releasing the overlapped ends of a steel strap, which is shown after a series of interlocking joints have been formed in its overlapped ends.

FIG. 6 is an enlarged, fragmentary detail taken from FIG. 5.

DETAILED DESCRIPTION OF PREFERRED EMBODIMENT

Figure 1:
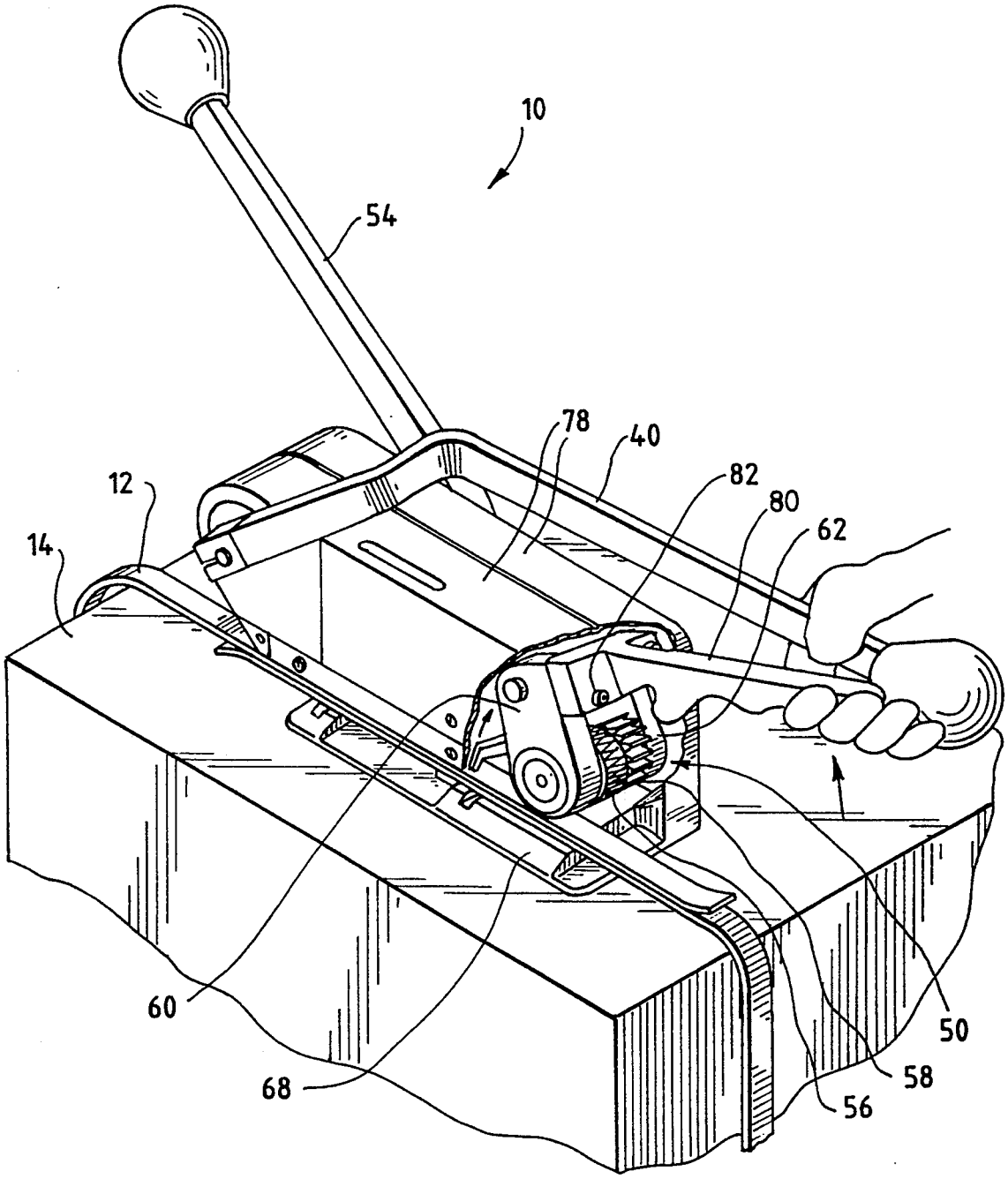
FIGS. 1 and 2 are fragmentary, perspective views of a strapping tool embodying this invention, as used to apply a steel strap around a package, wherein in In FIG. 1, portions of two side covers are broken away so as to reveal internal details.
Figure 2:
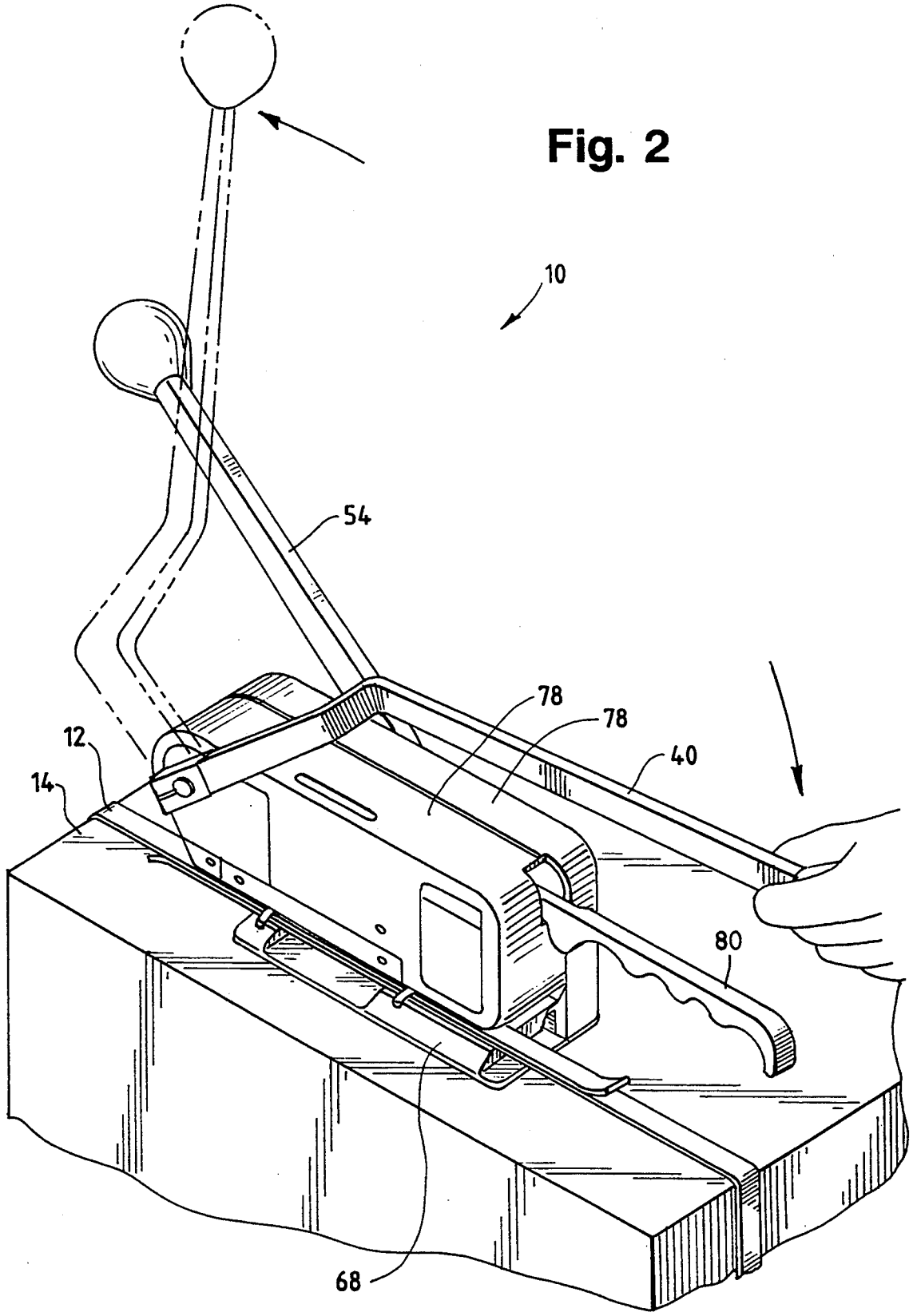
Figure 3:
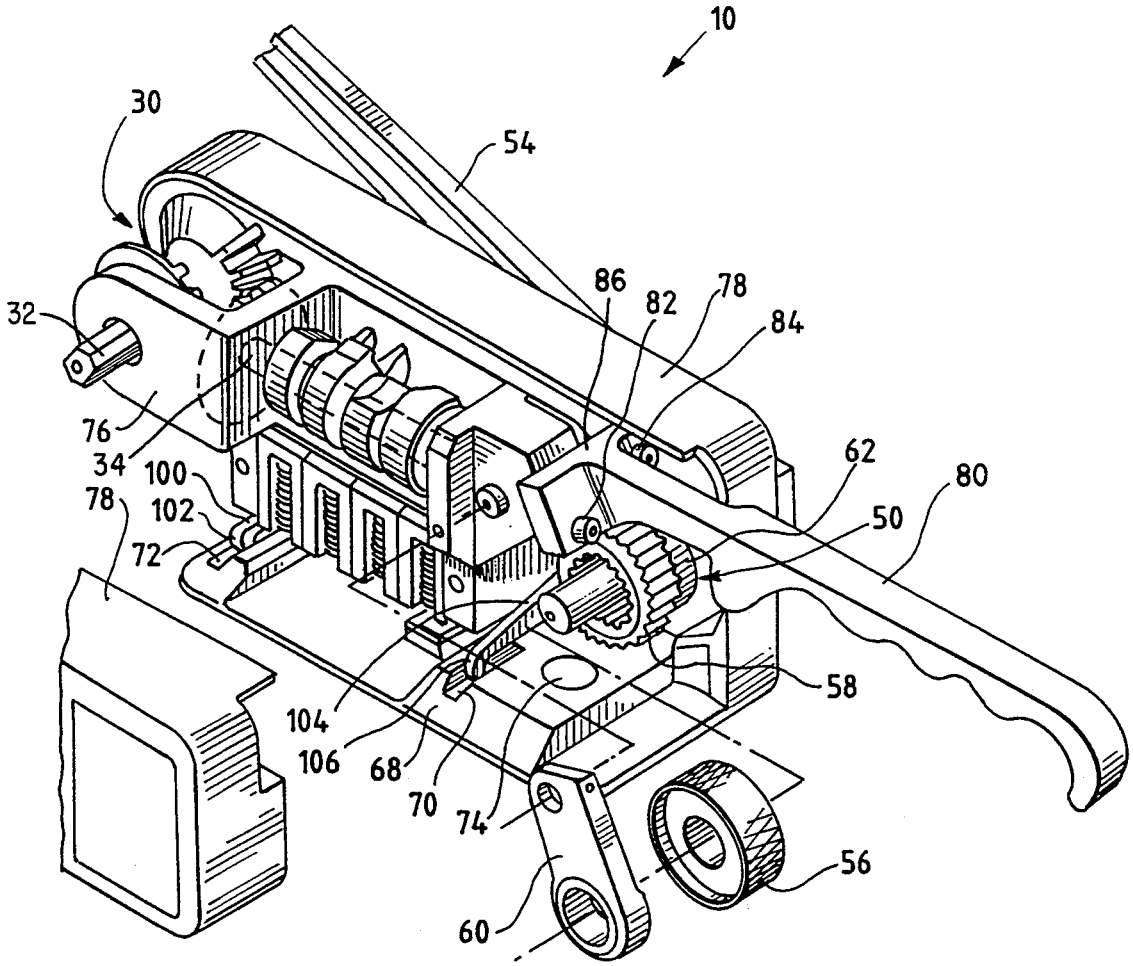
FIG. 3 is a view similar to that of FIGS. 1 and 2 but on a larger scale, wherein in FIG. 3, some elements including one of the side covers and an actuating handle are removed so as to reveal internal details, and wherein further, the strap and package are not shown.

As shown in the drawings, particularly in FIGS. 1, 2, and 3, a strapping tool 10 of the type noted above constitutes a preferred embodiment of this invention. The strapping tool 10 is used to apply a steel strap 12 in a tensioned loop around a package 14 and to join the strap (12 by means of a series of interlocking joints 16 (see FIG. 5) comprising interlockable shoulders 18 punched into the overlapped ends of the strap 12. As shown in FIGS. 4and 5, the strapping tool 10 embodies a mechanism 20 for admitting the overlapped ends into the tool 10, retaining the overlapped ends so as to facilitate punching the series of interlockable shoulders 18 into the overlapped ends, and releasing the overlapped ends from the tool 10.

While the overlapped ends of the strap 12 are retained by the mechanism 20, the series of interlockable shoulders 18 may then be punched into the overlapped ends through means of a series of cams 22, which are arranged to drive a series of punches 24. The cams 22 and punches 24 may be substantially similar to the cams and punches used in known strapping tools of the type noted above.

The cams 24 are driven by a mechanism 30 (see FIG. 3) for converting oscillatory rotation of an input shaft 32 (FIG. 3) to unidirectional rotation of an output shaft 34 mounting the cams 24 so as to enable the cams 24 to rotate conjointly with the output shaft 34. The mechanism 30 may be substantially similar to the converting mechanism disclosed in a copending patent application filed simultaneously herewith, assigned commonly herewith, and entitled MECHANISM FOR CONVERTING OSCILLATORY ROTATION OF INPUT SHAFT TO UNIDIRECTIONAL ROTATION OF OUTPUT SHAFT, Ser. No. 08/133,284, filed Oct. 8, 1993, the disclosure of which application is incorporated herein by reference. Alternatively, the mechanism 30 may be substantially similar to the converting mechanism disclosed in Nix U.S. Pat. No. 5,136,888, the disclosure of which patent is incorporated herein by reference.

An actuating handle 40 is secured to the input shaft 32 so that the input shaft 32 is rotated about its axis as the actuating handle 40 is pivoted about the same axis. The actuating handle 40 is manually pivotable over a range of pivotal motion, between a forward limit and a rearward limit, as limited by the mechanism 30. In FIG. 2, the actuating handle 40 is shown at its forward limit in dashed lines and at its rearward limit in full lines.

The strapping tool 10 comprises a mechanism 50 for tensioning the overlapped ends of the strap 12. Except as shown in the drawings and described herein, the mechanism 50 may be substantially similar to tensioning mechanisms used in known strapping tools of the type noted above.

The mechanism 50 comprises a transverse shaft 52, to which a tensioning handle 54 is secured so that the transverse shaft 52 is rotated about its axis as the tensioning handle 54 is pivoted about the same axis, along with a knurled wheel 56 and a ratchet gear 58. The knurled wheel 56 and the ratchet gear 58 are coupled to each other so as to be conjointly rotatable and are mounted on the transverse shaft 52 through means of a clutch (not shown) interposed between the ratchet gear 58 and the transverse shaft 52 and a pawl (not shown) coacting with the ratchet gear 58 so as to permit the knurled wheel 56 and the ratchet gear to rotate with the shaft 52 only in one rotational direction (counter-clockwise in the drawings) when the tensioning handle 54 is pivoted in the same directional and so as to prevent the knurled wheel 56 and the ratchet gear 58 from rotating when the tensioning handle 54 is pivoted oppositely. The shaft 52 is journalled to two pivotal links, in a manner to be later described, namely a link 60 and a link 62. The pawl noted above is mounted upon the link 62.

The strapping tool 10 comprises a fixed structure, which includes a base 68 extending longitudinally, defining a pair of similar, longitudinally spaced recesses, namely a forward recess 70 and a rearward recess 72. The base 68 mounts a knurled pad 74. The fixed structure further includes a frame 76, which is assembled from multiple parts, which is fixedly mounted upon the base 68 by means of fasteners (not shown), and which is upstanding from the base 68, and two side covers 78, which are secured by fasteners (not shown) to the frame 76. The output shaft 34 is journalled to the frame 76. A lever 80 is mounted to the link 60, by means of a fastener 82, and to the link 62, by means of two fasteners 84, at a flanged end 86 of the lever 80. The links 60, 62, are pivotably mounted upon the frame 76 by means of a pivot pin 88 so as to be pivotably movable with the lever 80, over a range of pivotal motion, between a normal position of the links 60, 62, and the lever 80 and a displaced position thereof. The pivot pin 88 defines a transverse axis. The links 60, 62, and the lever 80 are shown in the normal position in FIGS. 2 and 3 and in the displaced position in FIG. 1.

The links 60, 62, and the lever 80 are biased to the normal position in a manner to be later described. When the links 60, 62, and the lever 80 are positioned in the normal position, the overlapped ends of the strap 12 are pinched between the knurled wheel 56 and the knurled pad 74. Thus, the knurled wheel 56 bears against an upper one of the overlapped ends, while a lower one of the overlapped ends bears against the knurled pad 74. As the tensioning handle 54 is oscillated, the knurled wheel 56 draws the strap end bearing against the knurled surface of such wheel 56 and the other end of the strap 12 bears against the knurled pad 74, which prevents such other end from slipping, whereby the strap 12 is tensioned.

Further structural and functional details of the mechanism 50 for tensioning the strap 12 are outside the scope of this invention. Except as disclosed herein, the tensioning mechanism 50 may be substantially similar to the tensioning mechanisms used in known strapping tools of the type noted above.

As shown in FIGS. 4, 5, and 6, the mechanism 20 for admitting the overlapped ends of the strap into the tool 10, retaining the overlapped ends of the strap so as to facilitate punching the series of interlockable shoulders 18 into the overlapped ends of the strap, and releasing the overlapped ends of the strap from the tool 10 comprises a pair of similar, longitudinally spaced latches, namely a forward latch 100 having a hooked end 102 and a camming end 104 and a rearward latch 106 having a hooked end 108 and a camming end 110. Each latch is pivotally mounted upon the base 68, by means of a pivot bracket 112, which is secured to the base 68 by a fastener 114, and by means of a pivot pin 116, which extends through an aperture in the pivot bracket 112 and through an aperture in such latch, so as to be pivotably movable about a longitudinal axis defined by the pivot pin 116.

The mechanism 20 further comprises a camming member 120, which is an elongate, blade-like member movably mounted upon the frame 76 so as to be longitudinally movable between an advanced position and a retracted position. The advanced position corresponds to the latching position of the lever 80 and to the closed position of the latches 100, 106, and the retracted position corresponds to the unlatching position of the lever 80 and to the opened position of the latches 100, 106. The camming member 120 has two camming slots, namely a forward slot 122 receiving the camming end 104 of the forward latch 100 and a rearward slot 124 receiving the camming end 110 of the rearward latch 106. Each of the camming slots 122, 124 has a horizontal portion extending toward the transverse shaft 52 and an inclined portion extending oppositely. As shown, the forward slot 122 is closed at both ends, whereas the rearward slot 124 is opened at one end. The camming slots 122, 124, coact with the camming ends 104, 110, of the latches 100, 106, so as to pivot the latches 100, 106, from the closed position to the opened position upon longitudinal movement of the camming member 120 from the advanced position to the retracted position.

As described above, the transverse shaft 52 is spaced from the transverse axis defined by the pivot pin 88 mounting the links 60, 62. The camming member 120 has, near its rearward end 126, an end portion 130 defining a generally U-shaped pocket 132, which opens upwardly and through which the shaft 52 extends. The shaft 52 has a circular cross-section, which permits relative rotation of the shaft 52 and the pocket 132, where the shaft 52 extends through the pocket 132. The end portion 130 of the camming member 120 coacts with the shaft 52 in such a manner that the shaft 52 moves the camming member 120 longitudinally from the advanced position to the retracted position upon pivoting of the lever 80 from the latching position to the unlatching position.

The camming member 120 is biased toward the advanced position, so as to bias the links 60, 62, toward the normal position by means of the transverse shaft 52, and so as to bias the lever 70 to the latching position by means of the links 60, 62. The camming member 120, which extends through a narrow slot 134 in a portion 136 of the frame 76, has a longitudinal slot 140 that is closed at its forward and rearward ends and that defines a relatively short tab 142 at its rearward end and a relatively long tab 144 at its forward end. A coiled spring 150, which is disposed within the longitudinal slot 140, is piloted over the tab 142 at the rearward end of the spring 150 and bears against the frame portion 136 at the forward end of the spring 150 so as to bias the camming member 120. As the camming member 120 is advanced sufficiently, the tab 144 enters the spring 150 from the rearward end of the spring.

When the lever 80 is manually pivoted from the latching position to the unlatching position, the links 60, 62, are pivoted from the normal position to the displaced position, so as to move the camming member 120 longitudinally from the advanced position to the retracted position, whereby the camming ends 104, 110, of the latches 100, 106, coact with the inclined portions of the camming slots 122, 124, as exemplified by the camming end 104 which is shown in full lines in FIG. 6. Thus, the latches 100, 106, are pivoted from the latching position to the unlatching position.

When the lever 80 is released, the coiled spring 150 tends to move the camming member 120 longitudinally from the retracted position to the advanced position, whereby the camming ends 104, 110, of the latches 100, 106, coact with the inclined portions of the camming slots 122, 124, as exemplified by the camming end 104 which is shown in dashed lines in FIG. 6. Thus, the links 60, 62, are pivoted from the displaced position to the normal position, so as to pivot the lever 70 from the normal position to the displaced position, and so as to pivot the latches 100, 106, from the latching position to the unlatching position.

When the latches 100, 106, are pivoted to the latching position, the hooked end 102 of the forward latch 100 extends into the forward recess 70 and the hooked end 108 of the rearward latch 106 extends into the rearward recess 72, whereby the latches 100, 106, are disposed so as to retain the overlapped ends of a steel strap 12 between the latches 100, 106, and the base 68, and between the hooked ends 102, 108, and the frame 76. When the latches 100, 106, are pivoted to the unlatching position, the latches 100, 106, are displaced angularly from the latching position, and the hooked ends 102, 108, are removed from the recesses 70, 72, whereby the overlapped ends of the steel strap 12 can be either admitted into or removed from the strapping tool 10.

Various modifications may be made in the preferred embodiment described above without departing from the scope and spirit of this invention. It is therefore to be understood that within the scope of the appended claims, the present invention may be practiced otherwise than as specifically described herein.

I claim:

1. A strapping tool of the type used to apply a strap in a tensioned loop around a package and to join said strap by means of a series of interlocking joints comprising interlockable shoulders punched into longitudinally extending overlapped ends of said strap, comprising:

a longitudinally extending base having a recess defined therein;

a latch movably mounted upon said longitudinally extending base so as to be selectively movable between a closed position wherein said latch extends into said recess defined within said base so as to retain said longitudinally extending over-lapped ends of said strap between said latch and said base, and an opened position wherein said latch is displaced from said recess of said base and said closed position so as to permit admission of said longitudinally extending overlapped ends of said strap into said tool and to permit release of said longitudinally extending overlapped ends of said strap out from said tool; and longitudinally movable cam means for moving said latch from said closed position to said opened position and from said opened position to said closed position.

2. The strapping tool as set forth in claim 1, wherein:

said latch has a first end portion for engagement with said recess of said base, and a second end portion engaged with said cam means; and said cam means is movable between an advanced position and a retracted position, and has angular slot means defined therein for engagement with said second end portion of said latch such that when said cam means is moved to said retracted position, said second end portion of said latch is disposed in a first portion of said slot means such that said first end portion of said latch is disengaged from said recess of said base so as to correspond to said opened position of said latch, and when said cam means is moved to said advanced position, said second end portion of said latch is disposed in a second portion of said slot means such that said first end portion of said latch is engaged within said recess of said base so as to correspond to said closed position of said latch.

3. The strapping tool as set forth in claim 2, further comprising:

a frame extending upwardly from said base and having a slot defined therein; and said cam means is longitudinally movable within said slot defined within said frame between said advanced and said retracted positions.

4. The strapping tool as set forth in claim 3, further comprising:

spring means interposed between said cam means and said frame for biasing said cam means toward said advanced position.

5. The strapping tool as set forth in claim 4, wherein:

said cam means comprises a substantially flat, elongated blade-like member having an elongated slot defined therein; and said spring means is disposed within said elongated slot defined within said cam means wherein one end of said spring means is engaged with a wall portion of said cam means defining one end of said elongated slot, and a second end of said spring means is engaged with said frame for biasing said cam means relative to said frame.

6. A strapping tool of the type used to apply a strap in a tensioned loop around a package and to join said strap by means of a series of interlocking joints comprising interlockable shoulders punched into longitudinally extending over-lapped ends of said strap, comprising:

a longitudinally extending base;

a frame extending upwardly from said base;

a latch having a hooked end and being pivotably mounted upon said longitudinally extending base so as to be pivotable between a closed position wherein said latch is positioned so as to retain said longitudinally extending overlapped ends of said strap between said latch and said longitudinally extending base and between said hooked end and said frame, and an opened position wherein said latch is angularly displaced from said closed position so as to permit admission of said longitudinally extending overlapped ends of said strap into said tool and to permit release of said longitudinally extending overlapped ends of said strap from said tool; and longitudinally movable cam means for pivoting said latch from said closed position opened position and from said opened position to said closed position.

7. The strapping tool of claim 6, wherein:

said pivoting means comprises a lever pivotably mounted upon said frame so as to be pivotable about an axis between a latching position corresponding to said closed position of said latch, and an unlatching position corresponding to said opened position of said latch, said lever being linked to said latch in such a manner that pivoting of said lever from said latching position to said unlatching position results in pivoting of said latch from said closed position to said opened position, said lever being biased to said latching position so as to bias said latch to said closed position.

8. The strapping tool of claim 7, further comprising:

a handle pivotably mounted upon said frame so as to be pivotable over a range of pivotal movement between a forward limit of said range of movement and a rearward limit of said range of movement, said handle being positioned near said lever, when said handle is positioned at said rearward limit of said range of movement, so as to permit a user employing one hand to pivot said lever from said latching position to said unlatching position by grasping said handle and said lever and by squeezing said lever and said handle together so as to move said lever toward said handle.

9. The strapping tool of claim 8, wherein:

said longitudinally movable cam means is longitudinally movable between an advanced position corresponding to said latching position of said lever and to said closed position of said latch, and a retracted position corresponding to said unlatching position of said lever and to said opened position of said latch, said lever being linked to said cam means in such a manner that pivoting of said lever from said latching position to said unlatching position results in longitudinal movement of said cam means from said advanced position retracted position, said cam means being biased to said advanced position so as to bias said lever to said latching position, said cam means having a cam slot coacting with said latch so as to pivot said latch from said closed position to said opened position upon longitudinal movement of said cam means from said advanced position to said retracted position and so as to pivot said latch from said opened position to said closed position upon longitudinal movement of said cam means from said retracted position to said advanced position.

10. The strapping tool of claim 9, wherein:

said axis about which said lever is pivotable comprises a transverse axis; and a transverse member is spaced from said transverse axis and is arranged to move about said transverse axis as said lever is pivoted about said transverse axis;

said cam means having another cam surface coacting with said transverse member in such a manner that said transverse member moves said cam means from said advanced position to said retracted position upon pivoting of said lever from said latching position to said unlatching position.

11. The strapping tool as set forth in claim 9, wherein:

said frame has a slot defined therein; and said cam means is longitudinally movable within said slot defined within said frame between said advanced and said retracted positions.

12. The strapping tool as set forth in claim 11, further comprising:

spring means interposed between said cam means and said frame for biasing said cam means toward said advanced position.

13. The strapping tool as set forth in claim 12, wherein:

said cam means comprises a substantially flat, elongated blade-like member having an elongated slot defined therein; and said spring means is disposed within said elongated slot defined within said cam means wherein one end of said spring means is engaged with a wall portion of said cam means defining one end of said elongated slot, and a second end of said spring means is engaged with said frame for biasing said cam means relative to said frame.

14. A strapping tool of the type used to apply a strap in a tensioned loop around a package and to join said strap by means of a series of interlocking joints comprising interlockable shoulders punched into longitudinally extending overlapped ends of said strap, comprising:

a longitudinally extending base having a pair of recesses defined therein;

a frame extending upwardly from said base;

a pair of latches having hooked ends and being pivotably mounted upon said longitudinally extending base so as to be pivotable between closed positions wherein said latches are positioned with said hooked ends disposed within said recesses defined within said longitudinally extending base so as to retain said longitudinally extending overlapped ends of said strap between said latches and said longitudinally extending base, and between said hooked ends of said latches and said frame, and opened positions wherein said latches are angularly displaced from said closed positions so as to permit admission of said longitudinally extending overlapped ends of said strap into said tool and to permit release of said longitudinally extending overlapped ends of said strap out from said tool; and longitudinally movable cam means for pivoting said latches from said closed positions opened positions and from said opened positions to said closed positions.

15. The strapping tool as set forth in claim 14, wherein:

each one of said latches has a first end portion for engagement with a respective one of said recesses defined within said base, and a second end portion engaged with said cam means; and said cam means is movable between an advanced position and a retracted position, and has angular slot means defined therein for engagement with said second end portion of each one of said latches such that when said cam means is moved to said retracted position, said second end portion of each one of said latches is disposed in a first portion of said slot means such that said first end portion of each one of said latches is disengaged from said respective one of said recesses so as to correspond to said opened positions of said latches, and when said cam means is moved to said advanced position, said second end portion of each one of said latches is disposed in a second portion of said slot means such that said first end portion of each one of said latches is engaged within said respective one of said recesses of said base so as to correspond to said closed position of said latches.

16. The strapping tool as set forth in claim 15, wherein:

said frame has a slot defined therein; and said cam means is longitudinally movable within said slot defined within said frame between said advanced and retracted positions.

17. The strapping tool as set forth in claim 16, further comprising:

spring means interposed between said frame and said cam means for biasing said cam means toward said advanced position.

18. The strapping tool as set forth in claim 17, wherein:

said cam means comprises a substantially flat, elongated blade-like member having an elongated slot defined therein; and said spring means is disposed within said elongated slot defined within said cam means wherein one end of said spring means is engaged with a wall portion of said cam means defining one end of said elongated slot, and a second end of said spring means is engaged with said frame for biasing said cam means relative to said frame.

* * * * *